US005192034A

United States Patent [19]

Beisswanger

[11] Patent Number: 5,192,034

[45] Date of Patent: Mar. 9, 1993

[54] WINDER FOR WINDING A RUNNING WEB

[75] Inventor: Rudolf Beisswanger, Steinheim, Fed. Rep. of Germany

[73] Assignee: J.M. Voith GmbH, Heidenheim, Fed. Rep. of Germany

[21] Appl. No.: 680,316

[22] Filed: Apr. 4, 1991

[30] Foreign Application Priority Data

Apr. 5, 1990 [DE] Fed. Rep. of Germany ..... 4011010

[51] Int. Cl.[5] ..... B65H 18/16

[52] U.S. Cl. ..... 242/65

[58] Field of Search ..... 242/65, 66, 67.1 R

[56] References Cited

U.S. PATENT DOCUMENTS

| | | | |
|---|---|---|---|
| 3,614,011 | 10/1971 | Karr | 242/64 |
| 3,743,199 | 7/1973 | Karr et al. | 242/65 |
| 3,889,892 | 6/1975 | Melead | 242/56 R |
| 4,634,068 | 1/1987 | Malkki et al. | 242/65 |
| 4,979,689 | 12/1990 | Snygg | 242/65 |

*Primary Examiner*—John M. Jillions
*Attorney, Agent, or Firm*—Baker & Daniels

[57] ABSTRACT

A winder for winding a running web. The winder includes a backing roll having the width of the web and a winding drum on which the web is wound into a roll. A first pair of swivel levers (primary levers) each has a fork on one end for receiving a journal of the winding drum, and is mounted at the other end in the area of the backing roll axis such that the winding drum, while swiveling from a first position above the backing roll in the running direction of the web about the backing roll, approaches the backing roll and passes the primary section until reaching a second position. In the second position the winding drum, with the as yet incomplete paper roll, is taken over by a second pair of swivel levers (secondary levers). An essentially horizontal guideway extends from the second position across a secondary section up to a third position. A contact pressure device forces the winding drum with the paper roll being created on it down on the backing roll. A separate support beam is provided on each machine side (tending side and drive side) which relieves the winding drum/paper roll indirectly or directly at least on the primary section. Each support beam is designed and arranged so that the winding drum/paper roll, or its journal, can roll on it. At least one end of each support beam is movable to relieve the winding drum/paper roll.

2 Claims, 3 Drawing Sheets

WINDER FOR WINDING A RUNNING WEB

BACKGROUND OF THE INVENTION

The invention concerns a winder for the winding of a running web of paper, foil or the like. A backing roll, a winding drum on which the web is wound into a roll, and a first pair of swivel levers (primary levers) are utilized in the winder. The primary levers each feature on an end a fork for receiving a journal of the winding drum, and are mounted with the other end in the area of the backing roll axis in such a way that the winding roll, in swiveling from a first position above the backing roll in the running direction of the web about the backing roll, approaches the latter and passes a primary section. The winding roll then reaches a second position in which the winding drum with the as yet incomplete paper roll is taken over by a second pair of swivel levers (secondary levers). An essentially horizontal guideway extends from the second position via a secondary section up to a third position. A contact pressure device forces the winding drum with the paper roll being created thereon onto the backing roll.

Such winders, also called "Pope rollers," form generally the final section of a paper machine, serving to fashion the paper web accruing there into a roll form. But they are also used for rewinding an already completed roll so as to create a new roll.

In each case, the roll is to have very specific properties, particularly as concerns the winding hardness. Starting from a certain initial value, the winding hardness is to diminish to a limit value. This reduction is supposed to be maximally uniform from the first lap to the last. The reduction is to exhibit a specific gradient, i.e., should not be too heavy and not be too light. The progression of the winding hardness should at no rate display jumps, for instance a sudden drop.

All of this has so far been sought but not achieved. Instead, winders of known design produce rolls where the core is extremely hard and where toward the end—approximately at four-fifths of the roll diameter—there occurs a heavy drop in the winding hardness. As a result, the first part—that is, the extremely hard core—is unusable because the web is over-stretched in this area and breaks, so that this part must be discarded as scrap. In the end area, in which the roll is not wound sufficiently hard, a lateral shift of the laps relative to one another occurs, so that the end faces of the finished roll will appear frayed and the web edges may be slightly damaged.

Prior means for influencing the winding hardness are two measures which are used, e.g., on slitters. The one measure provides for subjecting the web during winding to a more or less heavy tension. The other measure consists in forcing the roll more or less heavily down on the backing roll, for instance by applying pressure on the axles of the winding drum or by applying contact pressure with a rider roll which is arranged parallel to the roll created and forced on it, so that a line pressure is created between the paper roll and the backing roll.

On winders of the category concerned here, the second measure is applied in the secondary section, as expressed above. The other device consists of a pair of swivel levers (secondary levers) of which each pushes down on an axle of the wrapped winding drum, thereby forcing the paper roll being created onto the backing roll. In the primary section, a line pressure is produced, by the weight of the winding drum/paper roll, between the paper roll being wound and the backing roll. The winding drum/paper roll is extremely heavy, reaching a deadweight of several tons, so that a correspondingly high line pressure is created. This line pressure is responsible for the extremely high winding hardness of the core of the roll.

In order to somewhat reduce the line pressure, and thus also the winding hardness in the core area, relief devices for the winding drum/paper roll have already been used which are supposed to act in the sense of uplifting the winding drum/paper roll and thus of a reduction of the line pressure. Theoretically, this is the case, too. Due to the inevitable vibrations of the entire machine during operation, however, a "dancing" occurs so that the relief can be performed only with care—and thus with little effectiveness—in order to prevent the winding drum/paper roll from jumping out of the forks of the first two swivel levers.

Thus, the problem of the excessively hard core has so far remained unmanageable. The problem could not be solved by accelerating the winding drum/paper roll prior to winding a new roll, to winding speed, in the upper apex area of the backing roll until the peripheral speed of the winding drum/paper roll and backing roll were synchronized. Neither has it so far been possible to solve the other problem, namely the aforementioned steep drop of the winding hardness in the limit range. Especially unfavorable in the course of the entire winding is the time span of transferring the created roll from the primary section to the secondary section. During this time span, the winding hardness is practically outside any control.

The problem underlying the invention is to give a winder such as that described above a design such that the winding hardness will have the desired progression from start to completion of the roll, that is, that the extreme hardness in the core area as well as the sudden drop in hardness in the middle or outer area will be avoided, and that the winding hardness is under control at any moment of the winding process. Additionally, of course, the mechanical expense is to be held as low as possible.

SUMMARY OF THE INVENTION

This problem is solved by the features of the present invention. Provided on each of the two machine sides (tending side and drive side) is a support beam that relieves the winding drum/paper roll, indirectly or directly, at least on the primary section. The two support beams are so designed and arranged that the winding drum/paper roll, or its journal, can roll on them. At least one end of each support beam is movable in the sense of relieving the winding drum/paper roll.

In detail, the following is achieved with the invention:

Through the arrangement of a pair of support beams it is possible to fashion the line pressure between the paper roll being created and the backing roll in the primary area completely as desired. It can even be completely eliminated. This may be desirable, for instance, in the case of NC papers ("no-carbon-required papers").

BRIEF DESCRIPTION OF THE DRAWINGS

The invention will be more fully explained with the aid of the drawings. The three figures illustrate each a Pope roller of essentially same construction. However, the inventional support beams differ in design in the three illustrated embodiments.

DESCRIPTION OF THE PREFERRED EMBODIMENT

Figure 1:
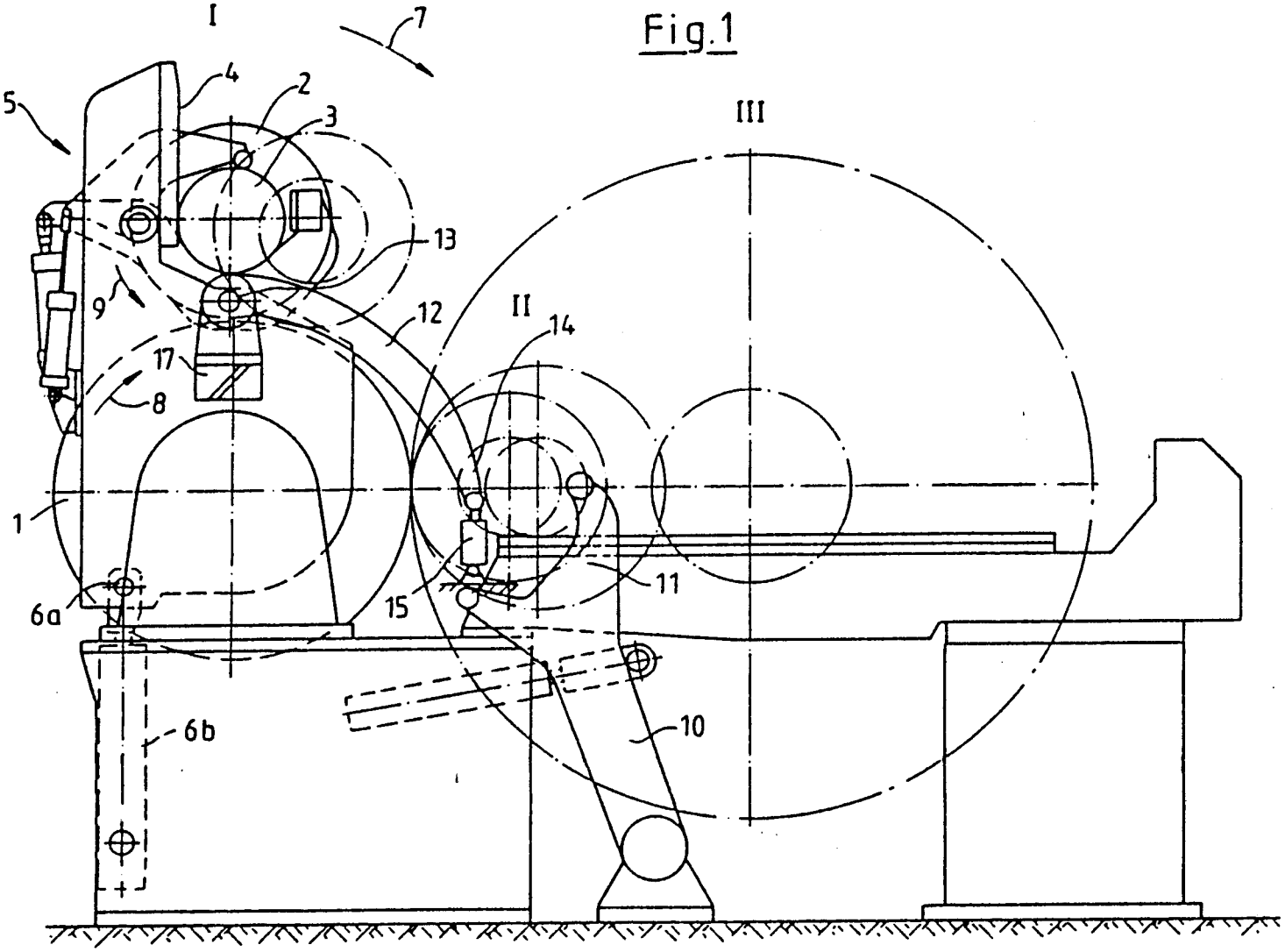

The Pope roller illustrated in FIG. 1 features a backing roll 1. A winding drum 2 possesses on each of its two ends a journal 3. Each journal 3 is mounted in a fork 4 of a primary lever 5. Thus, there are two primary levers 5 provided, one on the gear side of the Pope roller and the other on the tending side. Each primary lever 5 can be swiveled by means of a pneumatic drive 6*b* about a pivot 6*a*, and at that, on a circular path in the direction of arrow 7. The pivotal center of the primary levers 5 may be somewhat offset relative to the axis of rotation of the backing roll 1. But an advantage of the invention is constituted by the fact that the pivotal center may be arranged so as to be concentric with the axis of rotation of the backing roll 1.

In the operation, the web being wound (not shown) approaches from the left as seen in the figure. It loops around the winding drum 2 so as to be wound on it. The backing roll 1 and the winding drum/paper roll run then in the direction of arrows 8 and 9. Thus, the winding drum 2 is at first still empty and is then gradually wound (i.e., with paper), so that a partial roll and finally a complete roll is created. In this winding, the two primary levers 5—as mentioned above—perform the swivel movement according to arrow 7 along with the winding drum and the growing partial paper roll. In the process, the winding drum 2 with the partial paper roll proceeds from position I—approximately perpendicularly above the backing roll 1—to the position II. The winding drum/paper roll is transferred there by the primary levers 5 to a pair of secondary levers 10. The secondary levers 10 each have as well a fork 11 in which the respective journal 3 of the winding drum/paper roll 2 is being received. The secondary levers 10 are swivelable as well, and at that, in such a way that the winding drum with the partial roll can be moved on a horizontal secondary section between the position II, to a final position III. In position III, the roll is completely wound.

According to the invention, a support beam 12 is provided on both machine sides, i.e., on the tending side and on the gear side. The two ends of the individual support beams 12 are mounted in the machine frame. The individual support beam 12 represents a relief type gate control which supports the respective journal 3 of the winding drum/paper roll on the entire primary section, i.e., between position I and position II, relieving it to an exactly controlled extent. The line pressure between the growing paper roll and the shell surface of the backing roll 1 is thus adjustable as desired, and at that, at any point of this primary section.

Figure 2:
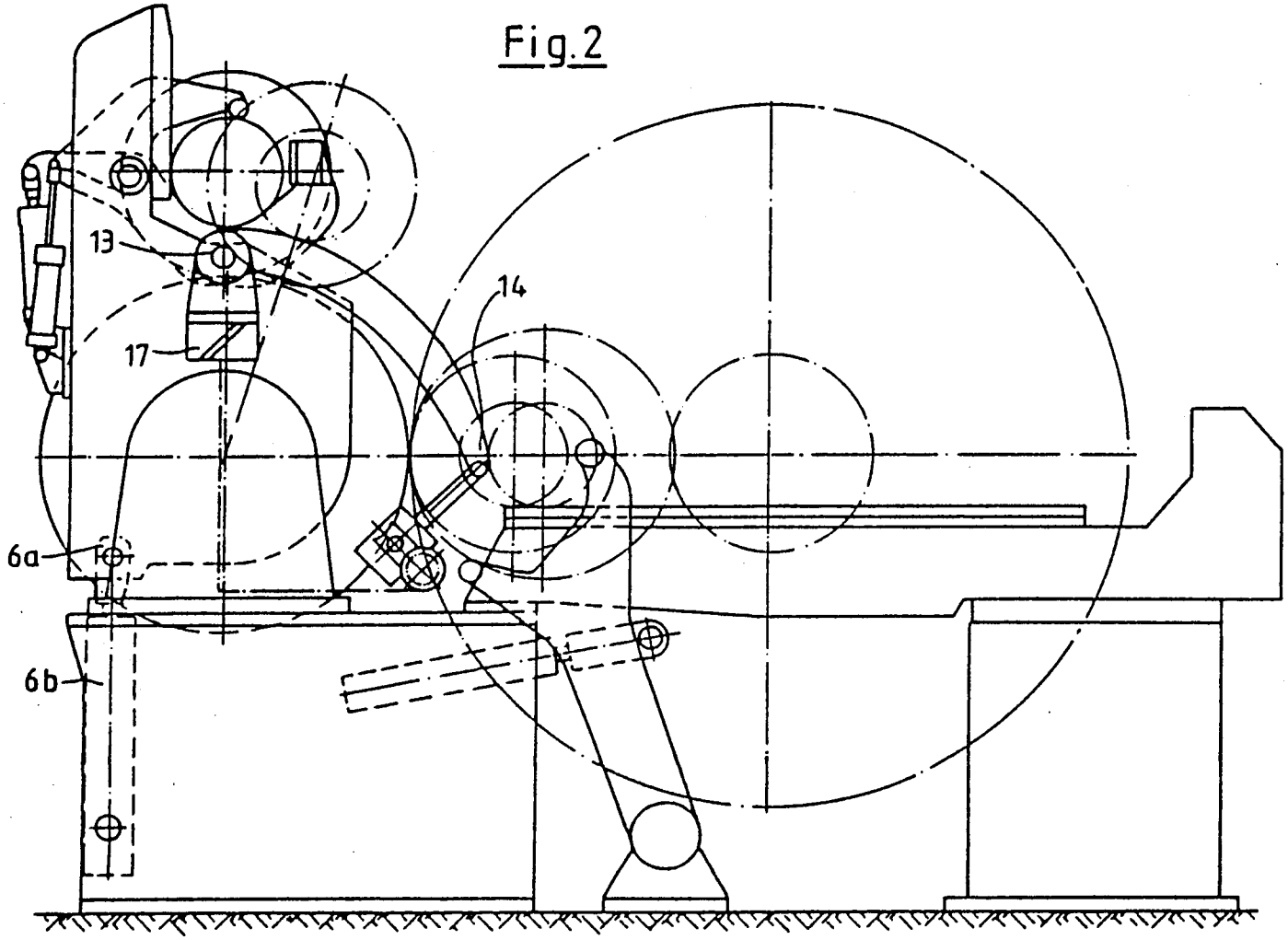

In the case of FIGS. 1 and 2, the support beams have a curved contour, and at that, in such a way that the center of curvature is situated on that side of the support beam 12 on which also the backing roll 1 is located. In the embodiment according to FIG. 3, the support beams are curved as well, but the center of curvature in this drawing is located on that side of the individual support beam 12 which is away from the backing roll 1.

In the embodiments according to FIGS. 1 and 2, the two ends 13 of the individual support beams 12 are mounted in stationary fashion, for instance in the machine frame, through the intermediary of a load cell 17. The two other ends 14 of the individual support beams 12, however, are freely adjustable in the embodiments according to FIGS. 1 and 2. In the case of the embodiment according to FIG. 1, a pneumatic unit 15 is provided for raising or lowering the respective end 14 of the individual support beam 12. The pneumatic unit 15, in turn, is mounted in stationary fashion with its one end. In the embodiment according to FIG. 2, a worm drive is provided as actuating organ for swiveling the individual support beams 12. The worm drive comprises a transverse shaft (not shown) and which by means of an electric motor is driven via an angular encoder, so that the drive of the two support beams will be absolutely synchronous.

Figure 3:
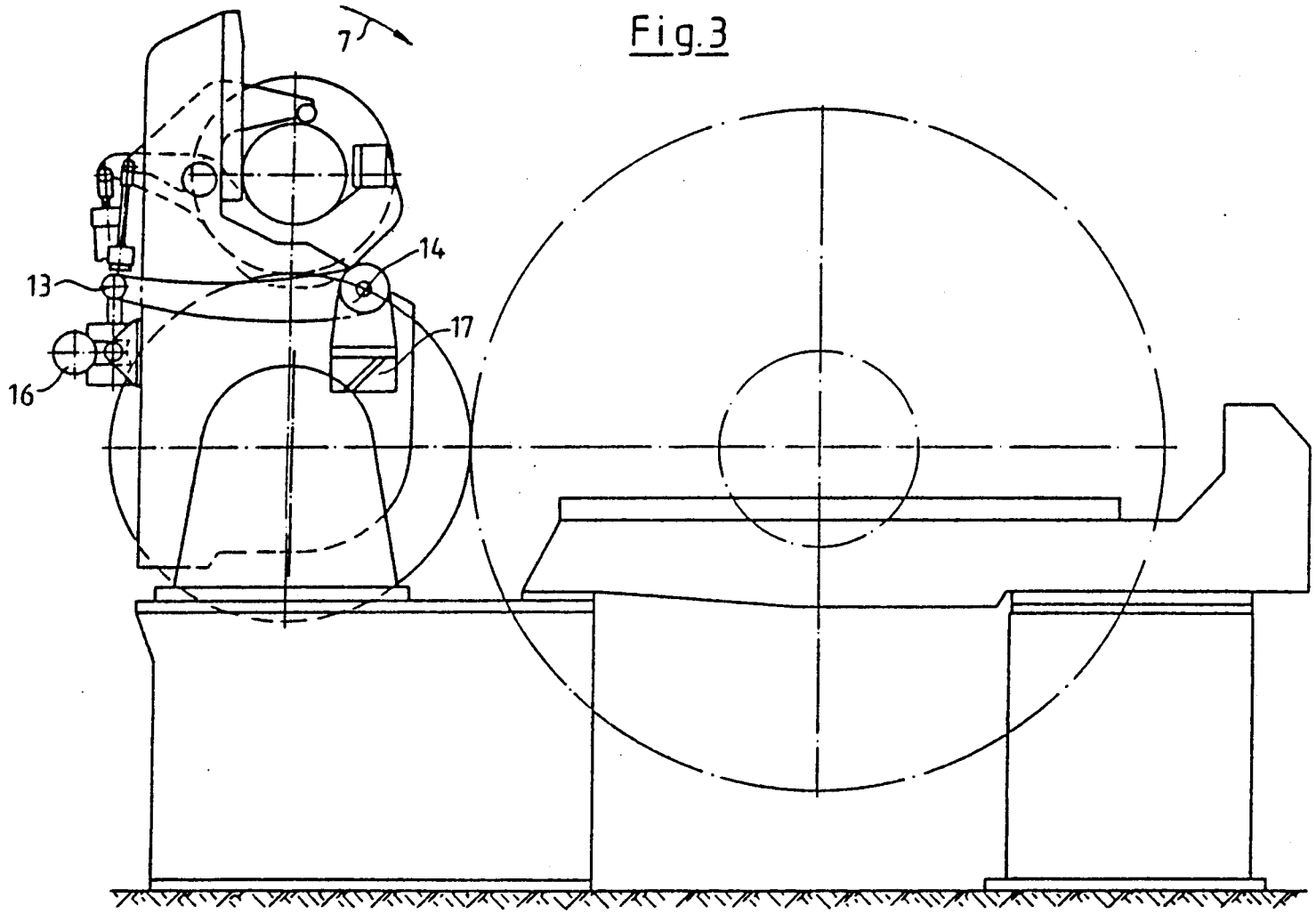

In variation from the first two embodiments, the two ends 13 and 14 of each support beam 12, in the embodiment according to FIG. 3, are mounted in a different way. As can be seen, a worm drive 16 engages the end 13 of the two support beams. A single drive motor drives the two ends 13 via a transverse shaft, assuring again an absolutely uniform movement on both sides. The swivel movement of the support beam 12 proceeds in this embodiment about the end 14 of the support beams 12. Besides, in this embodiment, the individual support beam 12 performs the swivel movement of the respective primary lever along with it, according to arrow 7. For that purpose, the end 14 of the individual support beam 12, for one, and the worm drive 16, for another, are mounted indirectly or directly on the respective primary lever 5.

In all of the embodiments the great advantage is constituted by the fact that the line force control, that is, the control of the force occurring between the partial paper roll and the shell surface of the backing roll 1, can be controlled in a very sensitive manner. The force can even be reduced to zero, so that no contact at all occurs between the partial paper roll and the shell surface of the backing roll 1.

A load cell 17 is suitably provided in all cases on those ends of the support beams 12 which form the pivotal center.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A winder for winding a running web, comprising:
a frame for said winder, said frame having two sides;
a winding drum on which said web is to be wound into a roll, said web having a width, said winding drum having two ends and having a journal on each of said ends;
a backing roll for said winding drum, said backing roll having a curved shell surface and having a width, said backing roll further having an axis, said width being substantially equal to the width of the web;
a pair of primary levers, each of said primary levers having two ends and having a fork at one end thereof whereby each of said forks receives a separate one of said journals, each of said primary levers being mounted at the other end thereof in closely spaced relationship to said backing roll axis;

said winding drum being swivelable from a first position whereby said winding drum is situated generally above said backing roll in the running direction of the web to a second position, said winding drum approaching said backing roll and passing through a primary section as it passes from said first position to said second position, said web being progressively wound on said winding drum as said drum passes from said first position to said second position;

a pair of secondary levers situated at said second position, said secondary levers being adapted to receive said winding drum from said primary levers as said drum passes to said second position;

a generally horizontal guideway extending from said second position via a secondary section to a third position;

a contact pressure device for forcing said winding drum and said roll being wound thereon onto said backing roll; and a pair of support beams, each of said support beams having two ends, said two ends of each support beam being mounted on the respective primary levers, one of said support beams being positioned at each side of said frame; each of said support beams being operable by way of controlled movement of at least one end thereof to relieve said winding drum, directly or indirectly, in at least said primary section; said support beams being configured and arranged so that said winding drum, or the journals disposed at the respective ends of said drum, can roll on said beams.

2. A winder according to claim 1, wherein said support beams, viewed in side elevation, are curved in accordance with the direction of curvature of the shell surface of the backing roll.

* * * * *